US005442713A

United States Patent [19]

Patel et al.

[11] Patent Number: 5,442,713

[45] Date of Patent: Aug. 15, 1995

[54] MICROPHONE PACKAGING SCHEME

[75] Inventors: Bakulesh B. Patel, Coral Springs, Fla.; Rebecca C. McNally, Stone Mountain, Ga.

[73] Assignee: Motorola, Inc., Schaumburg, Ill.

[21] Appl. No.: 202,855

[22] Filed: Feb. 25, 1994

Related U.S. Application Data

[63] Continuation of Ser. No. 941,601, Sep. 8, 1992, abandoned.

[51] Int. Cl.[6] ..... H04R 25/00

[52] U.S. Cl. ..... 381/168; 381/169; 379/431

[58] Field of Search ..... 381/168, 94, 155, 157, 381/71, 169, 170; 379/431, 433, 430, 440, 428

[56] References Cited

U.S. PATENT DOCUMENTS

| | | | |
|---|---|---|---|
| 3,548,121 | 12/1970 | Gorike . | |
| 3,947,646 | 3/1976 | Saito | 381/169 |
| 4,232,205 | 11/1980 | Ribeyre | 381/169 |
| 4,463,222 | 7/1984 | Poradowski . | |
| 4,847,818 | 7/1989 | Olsen | 379/433 |
| 4,850,016 | 7/1989 | Groves et al. . | |
| 4,926,474 | 5/1990 | Marks | 379/433 |
| 5,204,907 | 4/1993 | Staple et al. | 381/169 |
| 5,263,093 | 11/1993 | Nakamura et al. | 381/168 |

*Primary Examiner*—Curtis Kuntz
*Assistant Examiner*—Huyen D. Le
*Attorney, Agent, or Firm*—Dale W. Dorinski

[57] ABSTRACT

A packaging scheme (10) for a microphone (22) comprises a housing having first opening (50) and a second opening (52) at opposing ends of the housing. The microphone has a top portion and a bottom portion arranged within the housing wherein the top portion is exposed to the first opening and the bottom portion is exposed to the second opening. Finally, a porous membrane (20) is mounted between the microphone and the openings on the opposing ends of the housing. The porous membrane can be retained against the housing using a sticker (16).

18 Claims, 1 Drawing Sheet

MICROPHONE PACKAGING SCHEME

This is a continuation of application Ser. No. 07/941,601, filed Sep. 8, 1992, now abandoned.

TECHNICAL FIELD

This invention relates generally to microphone packaging schemes in general and particularly to a packaging scheme for a noise canceling microphone.

BACKGROUND

Pressure gradient microphones or noise canceling microphones and even omni-directional microphones suffer from rumbling noise when used in windy environments. The wind noise received by the microphone masks the speech signal of a user and degrades the signal to noise ratio (s/n) of the transmitted signal. In cellular phones and CT-2 phones, wind noise and breath noise particularly affect the signal to noise ratio. These phones typically pick up wind noise from two sources. One is the turbulences in the wind and the other is the sudden stoppage of the wind velocity in the vicinity of the microphone diaphragm. Thus, a microphone mounting or packaging scheme is needed that will reduce the sensitivity of the microphone in communication products in wind noisy environments and provide a minimum impediment to the speech signal received by the microphone.

SUMMARY OF THE INVENTION

A packaging scheme for a microphone comprises a housing having first opening and a second opening at opposing ends of the housing. The microphone has a top portion and a bottom portion arranged within the housing wherein the top portion is exposed to the first opening and the bottom portion is exposed to the second opening. Finally, a porous membrane is mounted between the microphone and the openings on the opposing ends of the housing.

DETAILED DESCRIPTION OF THE PREFERRED EMBODIMENT

Figure 1:
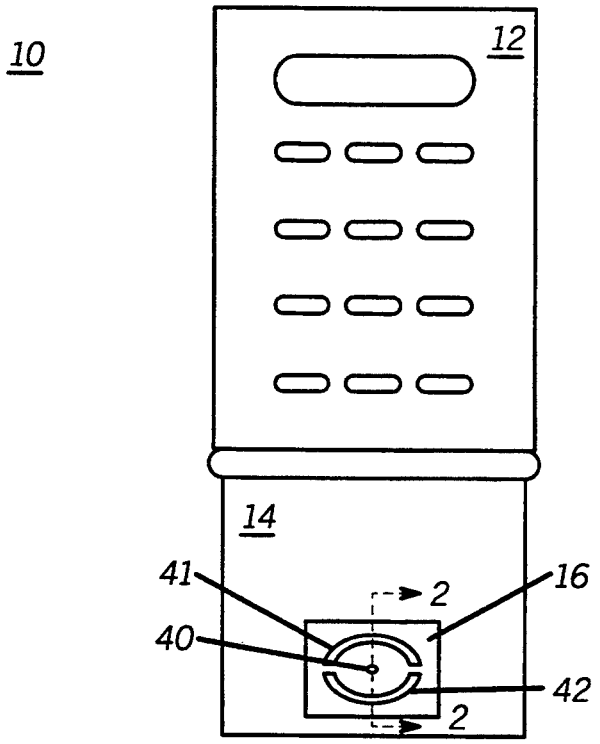
FIG. 1 is a front elevational view of a communication product having a microphone in accordance with the present invention.
Figure 2:
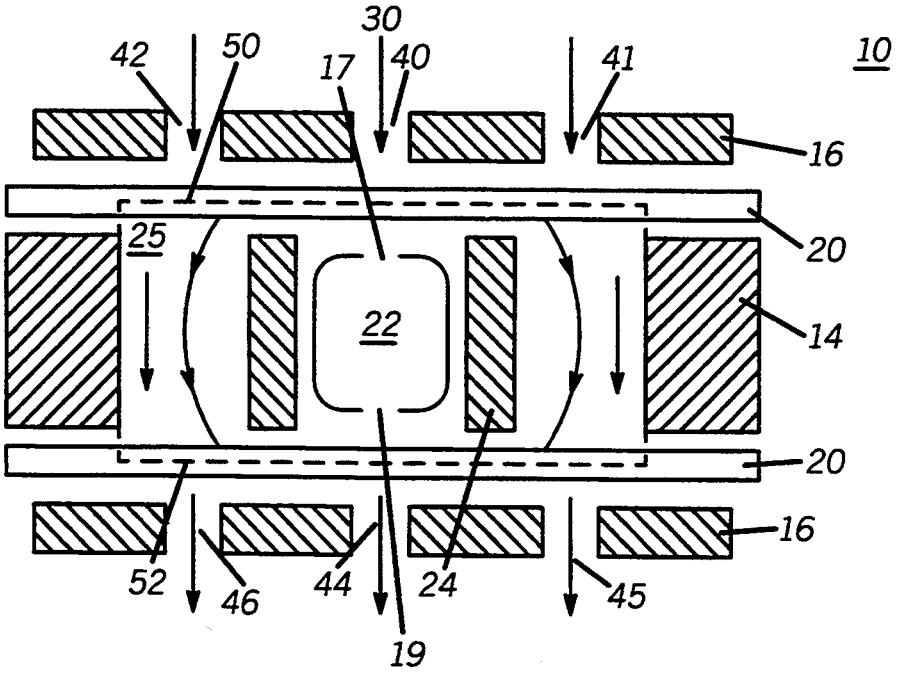
FIG. 2 is a a cross sectional view of a microphone in accordance with the present invention.

Referring to FIG. 1, there is shown a packaging scheme 10 for a microphone in a communication product 12 such as a cellular phone, CT-2 phone, or a two-way radio. Referring to FIG. 1 and 2, the communication product 12 preferably has a thin profiled flap 14, wherein a microphone 22 resides within the housing of the flap 14. FIG. 2 is a cross-sectional view of the flap shown in FIG. 1 through section 2—2. The housing of the flap 14 has a first opening 50 and a second opening 52 (shown by the dashed lines) at opposing ends of the housing. The microphone 22, is preferably a pressure gradient, directional, or noise canceling microphone, but a omni-directional microphone could be used as well in accordance with the present invention. The microphone is arranged within the housing to have its top portion or top port 17 exposed to the first opening 50 and the bottom portion (or the bottom port 19 in the case of a noise canceling microphone) exposed to the second opening 52. The microphone 22 is also preferably mounted within a boot 24 within a cylindrical cavity or chamber 25 formed by the two openings 50 and 52. A porous membrane 20 or screen, preferably a stainless steel mesh mounts on opposing sides of the flap 14 and preferably covers the entire area of the openings 50 and 52. Finally, a sticker 16 preferably having three openings 40, 41 and 42 is placed onto the porous membrane 20 and on the top opening 50. Another sticker 16 having openings 44, 45, and 46 is placed onto the porous membrane 20 covering the bottom opening 52 of the flap 14. The stickers 16 on opposing sides of the flap 14 aide in retaining the porous membranes 20 against the housing of the flap 14.

The structure of the present invention operates as a means for diverting the wind 30 around the microphone 22 through the openings 41 and 42 and out the opposite side openings 45 and 46 or vice-versa if the wind direction is opposite. The present invention will ideally reduce the wind noise from both the turbulences in the wind and the sudden stoppage of the wind velocity in the area of the microphone diaphragm (not shown). The porous member 20 or stainless steel mesh plays a vital role in achieving the reduction in wind noise. The resistance of the mesh 20 increases as the air velocity passing through the mesh increases. The pores in the mesh cause viscous losses to the air passing through it. Since the particle velocity of the speech signal is typically smaller than the particle velocity of the breeze of wind, the mesh 20 provides very little impediment to the speech signal. As the wind strikes the flap 14 of the phone, it causes numerous turbulences. The mesh 20 dissipates the energy from wind turbulences before they strike the microphone. Additionally, the chamber 25 is preferably larger than the microphone 22 and boot 24, allowing wind to pass from front to back and vice-versa. The extra space prevents the instantaneous fluctuating pressure in the front of the microphone (40). In other words, the extra space in the chamber 25 allows wind particles to pass from the top opening 50 to the back opening 52 without creating any back pressure in the top port of the microphone. In particular, referring to FIG. 2, if the wind 30 was blowing in the direction shown, most of the wind coming through the openings 41 and 42 would exit out openings 45 and 46 respectively. Most of the wind entering the opening 40 would be redirected towards the opening 52 and out the three sticker openings 44, 45, and 46.

What is claimed is:

1. A microphone packaging scheme, comprising:

a housing having first and second opposing sides;

a first aperture in the first side and a second aperture in the second opposing side;

a microphone having a top port, a bottom portion, and sidewalls;

the microphone disposed within the housing with the top port exposed to the first aperture and the bottom portion exposed to the second aperture;

the first aperture connected to the second aperture via an empty chamber in the housing, providing wind passage around the microphone and through the housing from the first side to the second opposing side; and a porous membrane between the top port and the first aperture in the housing, said porous membrane comprising steel mesh.

2. The microphone packaging scheme of claim 1, further comprising a porous membrane between the bottom portion and the second aperture in the housing.

3. The microphone packaging scheme of claim 1, wherein a sticker having apertures is applied over the first aperture and the cavity and on the porous membrane, wherein the sticker retains the porous membrane against the housing.

4. The microphone packaging scheme of claim 1, wherein the microphone is mounted within a boot in the housing.

5. The microphone packaging scheme of claim 1, wherein the microphone is an omni-directional microphone.

6. The microphone packaging scheme of claim 1, wherein the microphone is a noise-canceling microphone.

7. The microphone packaging scheme of claim 1, wherein the housing is a flap of a two-way radio.

8. A packaging scheme for diverting wind around a microphone, comprising:

a housing having first and second opposing sides;

a first aperture in the first side and a second aperture in the second opposing side;

a microphone having a top port and a bottom portion;

means for diverting the wind, comprising an empty chamber in the housing extending from the first side to the second opposing side and around the microphone, the chamber connected to the first and second apertures providing the wind passage through the housing from the first side to the second opposing side;

the microphone arranged within the housing so that the microphone top port is exposed to the first aperture and the microphone bottom portion is exposed to the second aperture; and a porous membrane between the top port and the first aperture in the housing, said porous membrane comprising steel mesh.

9. The packaging scheme of claim 8, further comprising a porous membrane between the bottom portion and the second aperture in the housing.

10. The packaging scheme of claim 8, wherein the microphone is mounted within a boot in the housing.

11. The packaging scheme of claim 8, wherein the microphone is a noise-canceling microphone.

12. The packaging scheme of claim 8, wherein the housing is a flap of a two-way radio.

13. A packaging scheme for a microphone, comprising:

a housing having a chamber connected to a first opening in a first side of the housing and a second opening in an opposing side of the housing:

a microphone having a top port and a bottom portion;

the microphone disposed within the housing with the top port exposed to the first opening and the bottom portion exposed to the second opening a portion of the chamber remaining empty to provide unimpeded passage of air around the microphone and through the housing from the first side to the second opposing side; and a porous membrane disposed between the top portion of the microphone and the first opening, said porous membrane comprising steel mesh.

14. The packaging scheme for a microphone of claim 13, further comprising a porous membrane disposed between the bottom portion and the second opening in the housing.

15. The packaging scheme for a microphone of claim 13, wherein the microphone is mounted within a boot in the housing.

16. A communication device having a packaging scheme for a microphone, comprising:

a housing having a chamber connecting a first opening and a second opening on opposing sides of the housing to provide passage of wind through the housing a noise canceling microphone having a top port and a bottom port;

the noise canceling microphone mounted in a boot within the chamber so that a portion of the chamber adjacent to the boot and around the microphone remains empty allowing wind to pass through the housing from the first side to the second opposing side;

a first stainless steel mesh covering the first opening and the top port and the empty portion of the chamber;

a second stainless steel mesh covering the second opening and the bottom port and the empty portion of the chamber;

a first sticker having three openings, mounted on the first opening of the housing and the first stainless steel mesh, wherein at least one of the openings of the first sticker exposes the stainless steel mesh above the top port of the microphone and at least one of the openings exposes the stainless steel mesh above the chamber; and a second sticker having three openings, mounted on the second opening of the housing and the second stainless steel mesh, wherein at least one of the openings of the second sticker exposes the stainless steel mesh above the bottom port of the microphone and at least one of the openings exposes the stainless steel mesh above the chamber.

17. The communication device of claim 16, wherein said device comprises a two-way radio.

18. The communication device of claim 17, wherein the housing is a flap of a two-way radio.

* * * * *